US006036779A

United States Patent [19]

Tolbert

[11] Patent Number: 6,036,779

[45] Date of Patent: Mar. 14, 2000

[54] BRACKETS TO HOLD SPOILERS FOR PAINTING

[76] Inventor: Richard L. Tolbert, 1471 Pampas Dr., Montgomery, Ala. 36117

[21] Appl. No.: 09/047,427

[22] Filed: Mar. 25, 1998

Related U.S. Application Data

[60] Provisional application No. 60/047,829, May 28, 1997.

[51] Int. Cl.[7] ..... B05C 13/00

[52] U.S. Cl. ..... 118/500; 269/47; 269/296

[58] Field of Search ..... 118/500; 269/47, 269/50, 296, 71

[56] References Cited

U.S. PATENT DOCUMENTS

| | | |
|---|---|---|
| 276,854 | 5/1883 | Millar . |
| 1,603,595 | 10/1926 | Hansen . |
| 2,036,459 | 4/1936 | Carter . |
| 4,577,843 | 3/1986 | Milwain . |
| 5,094,183 | 3/1992 | Hamasaki . |
| 5,296,030 | 3/1994 | Young . |
| 5,707,450 | 1/1998 | Thompson ..... 118/500 |

*Primary Examiner*—Michael W. Ball
*Assistant Examiner*—Michael A Tolin
*Attorney, Agent, or Firm*—Richard C. Litma

[57] ABSTRACT

A pair of C-shaped metal brackets mounted onto an existing painter's rack support an automobile spoiler, or other automobile part during the painting thereof. A bolt-nut assembly secures each C-shaped bracket onto the painter's rack through a hole in the lower horizontal member of each C-shaped bracket. Another bolt-nut assembly secures the spoiler onto each C-shaped bracket, using the existing hardware of the automobile spoiler which normally secures the spoiler to the automobile. Hinges facilitate the painting of both surfaces of a spoiler. After painting one surface of a spoiler, a painter can rotate the spoiler in order to paint another surface. This mechanism provides the painter access to the spoiler from different angles, allowing the application of a consistently even coat of paint. In alternative embodiments, one or more handles allow a painter to rotate the mounted spoiler more easily.

6 Claims, 3 Drawing Sheets

BRACKETS TO HOLD SPOILERS FOR PAINTING

CROSS-REFERENCE TO RELATED APPLICATION

This application claims the benefit of U.S. Provisional Patent Application Ser. No. 60/047,829, filed May 28, 1997.

BACKGROUND OF THE INVENTION

1. FIELD OF THE INVENTION

The present invention relates to work holders and, more specifically, to pivotal brackets for holding an automobile spoiler while it is being painted.

2. DESCRIPTION OF THE RELATED ART

Body work involving specific automobile components often warrants partial disassembly. The removal and isolation of an automobile part facilitates a thorough, complete treatment, especially when the task at hand involves painting. Many support systems exist for use in painting specific automobile parts as evidenced by the following U.S. patents.

U.S. Pat. No. 276,854, issued to Benedick Miller, for example, discloses carriage painter's adjustable horse or jack. The device enables a painter to turn a buggy-bed or, any other part of a buggy or carriage bed, in any desired position in a horizontal or vertical circle, for the purpose of painting, rubbing down, varnishing, or performing any other work to be done on the same. U.S. Pat. No. 1,603,595, issued to August L. Hansen discloses an automobile hood rack. The rack allows a painter to remove and paint the hood of a motor car separately to avoid accidentally smearing other parts of the car. U.S. Pat. No. 2,036,459, issued to Arnold H. Carter discloses an adjustable paint rack for automobile hoods. The device enables an auto painter to place the hood of an automobile on an adjustable rack whereby he can turn the hood at any angle.

Furthermore, U.S. Pat. No. 4,577,843, issued to Donald R. Milwain, discloses a vehicle door support. The device allows a vehicle door to be readily supported, by means of bolts threaded into bolt holes normally used for securement of the door hinges, at a desired position and adjustable about an axis of rotation to a desired work position. Damage or marking of the door can be minimized and the surfaces of the door to be worked on are normally unobstructed by the support permitting facile replacement of metal, application of body filler, priming, and spray painting. In addition, U.S. Pat. No. 5,094,183, issued to Masahiro Hamasaki discloses a rotating support apparatus for use in painting and drying an automobile bumper. Also U.S. Pat. No. 5,296,030, issued to Robert D. Young discloses a painting rack for a variety and multiplicity of vehicle parts.

All of the just-discussed prior art allows the suspension of various large automobile parts while painting and drying them. Some of the patents listed above also disclose means to adjust the position of the mounted automobile part. Unfortunately, no provisions for work on smaller automobile parts, such as sports car spoilers, are known. The location of spoilers on automobiles makes painting them and rendering body work on them difficult, often requiring the manual adjustment of the spoiler. However, upon manual adjustment, the painter often inadvertently blemishes the paint job, necessitating its repetition. This in turn results in a inefficient use of labor and supplies, compromised job quality, painter frustration and automobile owner dissatisfaction. Therefore, a specialized support system for spoilers and other small automobile parts, while not currently available, is highly desirable.

None of the above inventions and patents, taken either singly or in combination, is seen to describe the instant invention as claimed.

SUMMARY OF THE INVENTION

The present invention comprises a pair of C-shaped metal brackets that support an automobile spoiler, or other automobile part, and mount onto an existing painter's rack. A bolt-nut assembly secures each C-shaped bracket onto the painter's rack through a single hole in the lower horizontal member of each C-shaped bracket.

A substantially vertical member connects the upper and lower horizontal members of each C-shaped bracket. Hinging means connect the upper horizontal member of each C-shaped bracket to a substantially rectangular member, which is bent upwards, to engage the wide part of a T-shaped member. A hole in the thin part of the T-shaped member accommodates the bolt normally used to secure the automobile spoiler to the automobile. The narrowness of the stem section of the T-shaped member allows complete painting of the spoiler support members. A nut fixed within the automobile spoiler engages the spoiler bolt, securing the spoiler to the C-shaped bracket.

The hinging means of the disclosed device facilitates the painting of both surfaces of a spoiler. The hinging means maintains the spoiler in either a horizontal position, or in a vertical position. Hinges which lock into position are well known within the art of hinge making and are commonly referred to as cabinet hinges. After painting one surface of a spoiler, for example in a horizontal position, the hinge is released from a locked position so the painter can rotate the spoiler to a vertical position in order to paint another surface. This mechanism provides the painter access to the spoiler from different angles, allowing the application of a consistently even coat of paint.

In alternative embodiments, one or two handles affix to the substantially rectangular member or to the wide section of the T-shaped member on one or both of the C-shaped brackets. The handle or handles allow a painter to rotate the mounted spoiler more easily.

In addition to spoilers, the set of C-shaped brackets support other automobile parts. A single C-shaped bracket supports smaller automobile parts, including side-view mirrors, door handles, and other automobile workpieces.

Accordingly, it is a principal object of the invention to provide a device to support an automobile workpiece to avoid handling by a painter.

It is another object of the invention to allow a painter to rotate an automobile workpiece to expose different surfaces for painting.

It is a further object of the invention to stabilize an automobile workpiece using the hardware that is regularly used to secure the automobile workpiece to the automobile.

Still another object of the invention is to provide a specialized support system for automobile spoilers, side view mirrors and other automobile workpieces.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
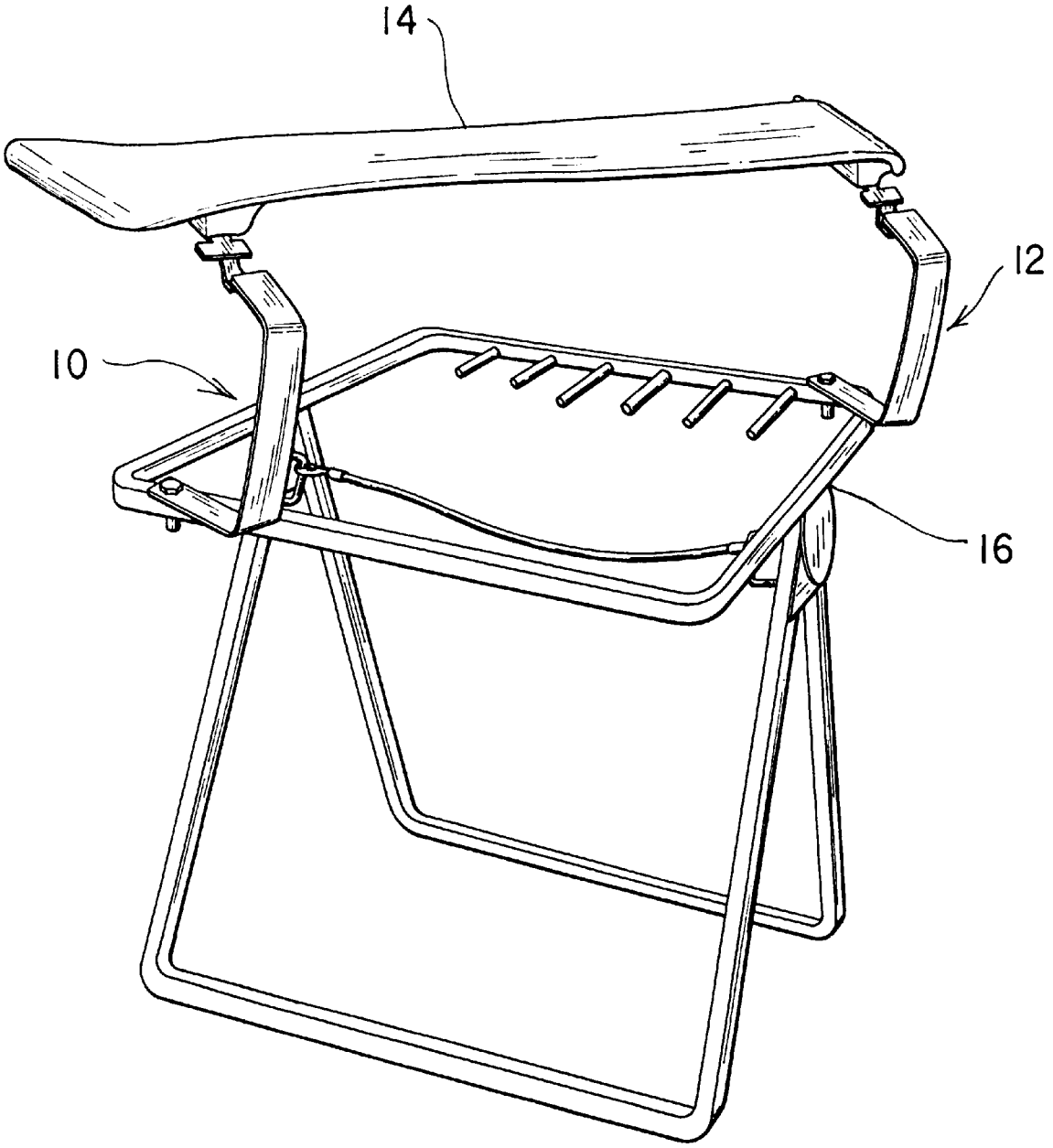
FIG. 1 is an environmental view of the bracket system securing a spoiler to a painter's rack in a horizontal position, according to the present invention.
Figure 2:
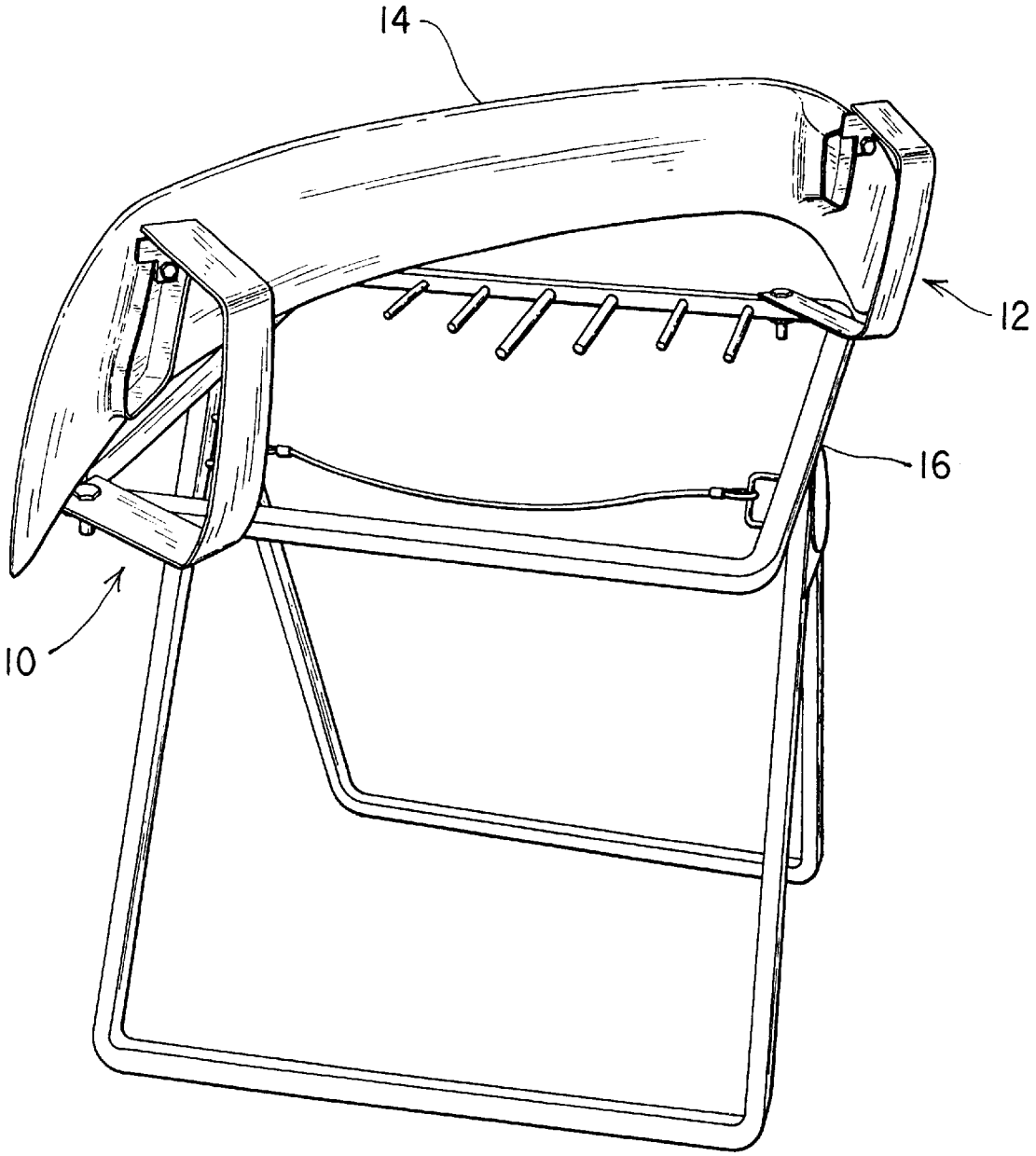
FIG. 2 is an environmental view of the bracket system of FIG. 1 securing a spoiler to a painter's rack in a substantially vertical orientation, according to the present invention.

With reference to FIGS. 1, the present invention comprises a pair of C-shaped metal brackets 10 and 12 that support an automobile spoiler 14 in a horizontal position, and mount onto an existing painter's rack 16. In FIG. 2, spoiler 14 has been repositioned, using the present invention, in a substantially vertical position on painter's rack 16.

Figure 3:
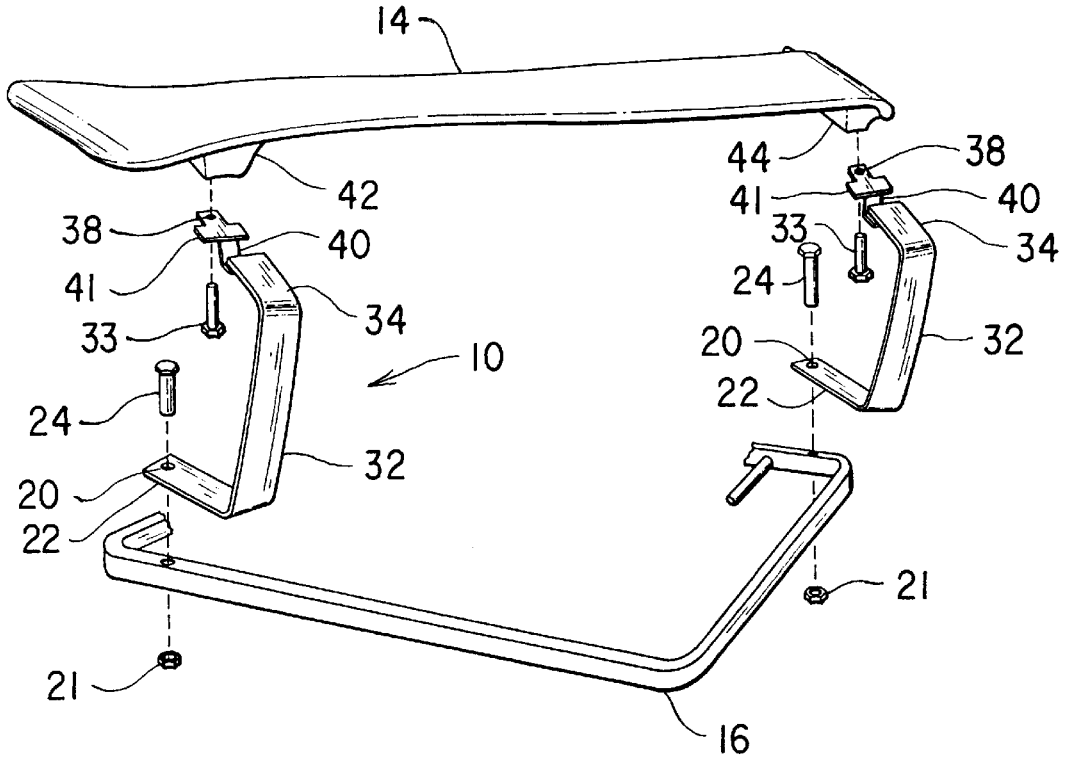
FIG. 3 is an exploded perspective view of the bracket system with a spoiler according to the invention illustrated in FIG. 1.

Referring now to FIG. 3, a hole 20 in the proximate end of the lower horizontal member 22 of C-shaped brackets 10 and 12 receives bolt 24, which secures C-shaped brackets 10 and 12 onto the upper surface of painter's rack 16. A nut 21 engages bolt 24 at the lower surface of painter's rack 16, further securing the assembly in place.

A substantially vertical member 32 extends upwards from the end of lower horizontal member 22 opposite to the end that incorporates hole 20. A horizontal member 34 extends from the top of substantially vertical member 32 in the same direction as lower horizontal member 22. Hinging means 36 connect the free end of horizontal member 34 to a substantially rectangular member 40, better illustrated by FIG. 4A and FIG. 4B. The other end of the substantially rectangular member 40 bends upwards and engages the center of the wide section of T-shaped member 41. A hole 38 in the narrow stem section of T-shaped member 41 accommodates the bolt 33 of spoiler 14. The narrowness of the stem section of T-shaped member 41 allows complete painting of the spoiler support members 42 and 44. Holes in the bottom of spoiler support members 42 and 44 further accommodate bolts 33, to thereby secure spoiler 14 to C-shaped brackets 10 and 12.

Figure 4A:
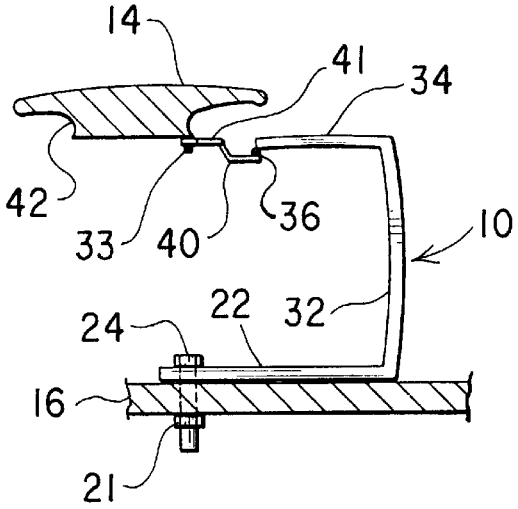
FIG. 4A is a side view of the bracket holding a spoiler in a horizontal orientation according to the invention illustrated in FIG. 1.
Figure 4B:
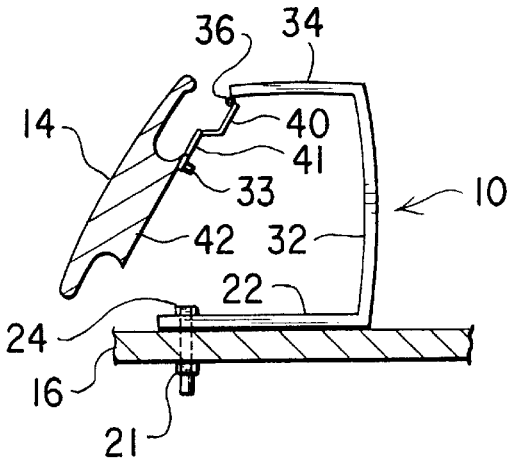
FIG. 4B is a side view of the bracket holding a spoiler in a substantially vertical orientation according to the invention illustrated in FIG. 1.

The hinging means of the disclosed device facilitate the painting of both surfaces of a spoiler. The hinging means maintains the spoiler in either a horizontal position with the hinge locked in place or a vertical position, after unlocking the hinge. Hinges which lock into position are well known within the art of hinge making and are commonly referred to as cabinet hinges. FIG. 4A illustrates the C-shaped bracket system supporting spoiler 14 in a horizontal orientation. After painting one surface of spoiler 14, the painter can rotate spoiler 14 downwardly, so that it is positioned in a substantially vertical orientation, and another surface can be painted, as shown in FIG. 4B. This mechanism allows the painter to access spoiler 14 from different angles, allowing the application of a consistently even coat of paint.

In alternative embodiments, one or two handles (not shown) may be affixed to substantially rectangular member 40 or to the wide section of T-shaped member 41 on one or both of the C-shaped brackets. The handle or handles allow a painter to rotate the mounted spoiler more easily.

In addition to spoilers, the set of C-shaped brackets support other automobile parts. A single C-shaped bracket supports smaller automobile parts, including side-view mirrors and door handles.

It is to be understood that the present invention is not limited to the embodiments described above, but encompasses any and all embodiments within the scope of the following claims.

I claim:

1. A workpiece support system for automobile parts comprising:

a pair of C-shaped brackets;

means to pivotally attach an automobile part to said C-shaped brackets; and means to mount said C-shaped brackets on a painter's rack;

whereby, said C-shaped brackets support an automobile part being painted in a plurality of positions so that a painter can rotate the automobile part without handling it and can apply a consistently even coat of paint to the different automobile part surfaces.

2. The workpiece support system for automobile parts as claimed in claim 1, wherein said means to pivotally attach an automobile part to said C-shaped brackets comprise:

a pair of substantially T-shaped members, one for each C-shaped bracket;

means for temporarily attaching an automobile workpiece to each T-shaped member;

a pair of offset legs for attaching each T-shaped member to its respective C-shaped bracket; and a pair of hinges, connecting each leg to its respective C-shaped bracket.

3. The workpiece support system for automobile parts as claimed in claim 2, wherein said means for temporarily attaching an automobile workpiece to each T-shaped member comprise a pair of threaded bolts, one for each C-shaped bracket.

4. In combination, a painter's rack and a workpiece support system for automobile parts comprising:

a bifold leg stand assembly and a substantially horizontal, open support structure, seated upon said leg stand assembly;

a pair of C-shaped brackets;

means to pivotally attach an automobile part to said C-shaped brackets; and means to mount said C-shaped brackets on a painter's rack;

whereby, said C-shaped brackets support an automobile part being painted in a plurality of positions so that a painter can rotate the automobile part without handling it and can apply a consistently even coat of paint to the different automobile part surfaces.

5. The painter's rack and workpiece support system for automobile parts as claimed in claim 4, wherein said means to pivotally attach an automobile part to said C-shaped brackets comprise:

a pair of substantially T-shaped members, one for each C-shaped bracket;

means for temporarily attaching an automobile workpiece to each T-shaped member;

a pair of offset legs for attaching each T-shaped member to its respective C-shaped bracket; and a pair of hinges, connecting each leg to its respective C-shaped bracket.

6. The painter's rack and workpiece support system for automobile parts as claimed in claim 5, wherein said means for temporarily attaching an automobile workpiece to each T-shaped member comprise a pair of threaded bolts, one for each C-shaped bracket.

* * * * *